US006820407B2

(12) United States Patent
Feuerlohn et al.

(10) Patent No.: US 6,820,407 B2
(45) Date of Patent: Nov. 23, 2004

(54) OPENING ARRANGEMENT FOR AN OPEN-END SPINNING FRAME

(75) Inventors: Helmut Feuerlohn, Mönchengladbach (DE); Thomas Weide, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 147 days.

(21) Appl. No.: 10/228,686

(22) Filed: Aug. 27, 2002

(65) Prior Publication Data

US 2003/0041587 A1 Mar. 6, 2003

(30) Foreign Application Priority Data

Aug. 30, 2001 (DE) ..... 101 42 488

(51) Int. Cl.[7] ..... D01H 4/32
(52) U.S. Cl. ..... 57/400; 57/408
(58) Field of Search ..... 57/400–417; 19/100, 19/108, 218, 262–265

(56) References Cited

U.S. PATENT DOCUMENTS

| | | | | |
|---|---|---|---|---|
| 2,228,809 A | * | 1/1941 | Solanas | 15/256.52 |
| 2,847,718 A | * | 8/1958 | Dudley | 15/256.52 |
| 3,217,365 A | * | 11/1965 | Hattori | 19/218 |
| 3,889,318 A | * | 6/1975 | Leinek et al. | 19/105 |
| 4,392,276 A | | 7/1983 | Gauvain et al. | 19/97 |
| 4,471,607 A | | 9/1984 | Schmolke | 57/408 |
| 4,797,979 A | | 1/1989 | Staheli et al. | 19/105 |
| 5,054,166 A | * | 10/1991 | Demuth et al. | 19/113 |
| 5,446,945 A | * | 9/1995 | Hachenberger | 19/107 |
| 5,566,541 A | | 10/1996 | Stahlecker et al. | 57/408 |
| 5,775,086 A | | 7/1998 | Stahlecker | 57/408 |
| 5,845,477 A | | 12/1998 | Stahlecker | 57/411 |
| 5,890,356 A | | 4/1999 | Stahlecker | 57/401 |
| 6,226,838 B1 | | 5/2001 | Raasch | 19/115 R |

FOREIGN PATENT DOCUMENTS

| | | |
|---|---|---|
| CH | 620 949 | 12/1980 |
| DE | 24 18 516 B2 | 10/1975 |
| DE | 29 32 562 A1 | 2/1981 |
| DE | 34 39 664 A1 | 4/1986 |
| DE | 196 08 828 A1 | 9/1997 |
| DE | 196 08 830 A1 | 9/1997 |
| DE | 196 10 960 A1 | 9/1997 |
| DE | 198 50 518 A1 | 5/2000 |
| EP | 0 446 883 A1 | 9/1991 |

OTHER PUBLICATIONS

European Search Report.
German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

An opening arrangement for an open-end spinning device with a rotating opening roller having opening elements stationarily arranged on its circumference for opening a delivered sliver into individual fibers and for combing out the fibers at a comb-out point. The opening roller has a mechanical stripping arrangement that rotates along with it. The stripping arrangement includes ejectors that are pivotably fastened on the opening roller. Each ejector is arranged between the opening elements and extends over the opening roller transversely in relation to the direction of rotation. The ejector strips combed-out fibers off the opening elements and improves the opening of the opening roller as well as the transfer of the fibers from the opening roller. The opening arrangement is advantageously employed with an open-end spinning frame.

14 Claims, 7 Drawing Sheets

OPENING ARRANGEMENT FOR AN OPEN-END SPINNING FRAME

CROSS-REFERENCES TO RELATED APPLICATIONS

This application claims the benefit of German Patent Application DE 10142488.4, filed Aug. 30, 2001, herein incorporated by reference.

FIELD OF THE INVENTION

The present invention relates to an opening arrangement for an open-end spinning device, in particular to an opening arrangement having a rotating opening roller having opening elements stationarily arranged on the circumference for opening a delivered sliver into individual fibers and for combing the fibers at a comb-out point.

BACKGROUND OF THE INVENTION

In connection with open-end spinning processes, such as during friction spinning, as well as in connection with the rotor spinning process, fibers delivered into the spinning process are separated into individual fibers by means of an opening roller. In order to prevent the compression of fibers, it is customarily desired that the fiber material be constantly accelerated during its entire travel from the feeding device of the opening roller to the yarn withdrawal device, so that the fibers are maintained in a stretched state and are not compressed. In the course of this, the withdrawal speed should not become too great. As a result of this, the circumferential speed of the opening roller is limited, since it must be lower than the yarn withdrawal speed. The permissible number of revolutions of such an opening roller is clearly lower than the number of revolutions of an opening roller that is employed during the customary open-end rotor spinning process. The high circumferential speeds of the opening roller in rotor spinning contribute to the prevention of an uneven opening of the delivered fibers and an increased separation of fiber bunches which are not, or only incompletely opened. While in rotor spinning the opening roller customarily runs at a speed of approximately 8000 rpm, the number of revolutions of the opening roller in friction or air spinning, for example, is only 1800 rpm because of the above mentioned conditions. At such low numbers of revolutions of the opening roller the occurring centrifugal forces are reduced to such an extent that the detaching of the fibers from the opening roller is only insufficiently aided by the centrifugal forces. The transfer of fibers from the opening roller to the respective collecting device, for example a suction roller with a perforated surface, is correspondingly inadequate. To lessen the effects of this disadvantage at least somewhat, opening rollers are employed whose combing, or opening elements consist, for example, of needles which are not inclined in the running direction of the opening roller.

Customarily, opening elements of opening rollers are inclined at an angle of 15 to 20 degrees in the running direction of the opening roller in order to further the draw-in of the fibers and their combing-out of the free end of the delivered fibers, the so-called fiber tuft. The edge of the opening element that is in front in the running direction is called tooth face in connection with sets of saw-teeth, whose inclination in the running direction is called a positive face angle. However, a positive face angle makes the removal of the fibers from the opening roller more difficult.

Although the opening and transfer of delivered fibers which, for example, consist of 100% cotton, is possible with needles which have no inclination, the quality of the combing-out process suffers considerably from the omission of the inclination.

However, such measures are insufficient for the satisfactory opening and transfer to the collecting member of delivered fibers consisting of a mixture of polyester and cotton. After a short time, often after only a few seconds, the fibers begin to wind around the opening roller and the opening process is hampered in a sustained manner or even stopped.

A needle roller, between whose needles bendable rods have been placed, for feeding a sliver to the combing element of an open-end spinning device is known from German Patent Publication DE-AS 24 18 516. The rods are intended to replace an elastic cover of a known device in which the needles are embedded up to their tips, and to prevent the formation of a winding on the needle roller. The rods extend between two supports arranged on the two front faces of the roller and permit the compression, or concentration, of the fiber at the places where it rests against the rods. The sliver is pressed against the feed table by the rods. In order to exert this pressure, it is necessary for the sliver to be so compact and thick that it deflects the rods out of their position of rest. Thus, the employment of the bendable rods is limited to the feed device of an opening arrangement.

Swiss Patent Publication CH-PS 620 949 discloses a feed roller for a combing cylinder, which has needles conducted in radial bores of the feed roller surface. The needles are moved between a withdrawal and a push-out position. Hence, it is intended to improve the opening of the fibers between the feed roller and the combing roller. An arrangement with movable needles is mechanically complex and open to malfunctions. Due to the movement of the needles inward in a radial direction, fibers are pulled along into the gap between the needle and the roller surface and collect there. In the course of the subsequent extension of the needles, the fibers can become stuck in the radial bore and can block the needle by means of a wedge effect. The use of saw-teeth in place of needles is not possible here. Such arrangements have not been accepted.

With opening rollers rotating at a number of revolutions which is multiple times greater than the number of revolutions of a draw-in roller, additional air flows are created in order to affect the fiber conveyance and the opening process.

German Patent Publication DE 196 08 828 A1 shows an opening roller which is provided with openings for generating radial airflow at the circumference. The opening roller is equipped with a set of teeth.

However, the generation of airflow entails additional compressed air consumption at each spinning position, which represents a considerable cost factor in connection with spinning arrangements with a plurality of spinning positions. A further disadvantage when employing airflow is caused in that the speed of the airflow that exits from such a perforated roller is greater than the speed of a fiber just separated from the rollers. Due to this, the airflow blows against the fiber end and the fiber is compressed in an undesirable manner.

German Patent Publication DE 198 50 518 A1, which defines the species, shows an opening roller which, together with a support roller, combs out the fiber tuft. Additional compressed air consumption can be avoided for this reason. Although the opening of slivers is improved, the problem of the winding of fibers, or of an unsatisfactory transfer of the fibers from the opening roller to the collecting member, is not solved.

SUMMARY OF THE INVENTION

It is accordingly an object of the present invention to improve the function of the opening roller.

According to the present invention, this object is addressed by means of an opening arrangement for an open-end spinning device having a rotating opening roller with opening elements stationarily arranged on its circumference for opening a delivered sliver into individual fibers and for combing the fibers at a comb-out point, the rotating opening roller having a mechanical stripping arrangement that rotates along with the rotating opening roller.

It is possible with the opening roller of the present invention to lift fibers that, depending on the type of the opening element used, have been taken along by individual needles or teeth, in the area of the collecting member and to remove them from the opening elements, or from the set of teeth. The transfer of fibers from the opening roller to the collecting member is considerably improved. The extent of this improvement even permits the employment of needles or teeth of the opening roller having a positive face angle in order to perform better combing, without the fiber transfer from the opening roller to the collecting member again being impermissibly hampered, for example in connection with fibers that are difficult to process, or with fiber mixtures.

When employing airflow to aid in the functioning, the air pressure, and therefore the consumption of air, which aid in releasing the fibers by compressed air, can be considerably lowered in comparison to known devices. For example, the vacuum required for applying suction to an opening roller can be reduced from 130 mbar to 50 mbar. Stretching of the fibers during transfer is improved.

The winding tendency of fibers on the opening roller can be reduced or even stopped altogether at the low number of revolutions mentioned above. Even delivered fibers whose material consists of a mixture of polyester and cotton can be easily processed by the opening roller of the present invention.

In a preferred embodiment of the present invention, the opening arrangement has movable ejectors that are arranged between the opening elements and extend over the opening roller transversely in relation to the rotating direction and are preferably pivotably fastened on the opening roller. Preferably, one ejector is associated with every row of opening elements extending substantially transversely in relation to the rotating direction of the opening roller. When reaching the location on the circumference intended for the fiber transfer, such ejectors make it possible to simply provide the removal of the fibers carried along in a manner such that they are evenly distributed in width and functionally dependable.

In another preferred embodiment, the ejector is embodied as a wire hoop. This ejector can be simply and cost-effectively produced as well as easily fastened in bores on either side of the opening roller having only a small mass needing to be moved.

In yet another preferred embodiment, a stationary ring-shaped guide device for the ejectors is embodied and arranged in such a way that by its action the position of the respective circulating ejector in relation to the opening roller is cyclically changed. One cycle corresponds to one revolution of the opening roller. It is possible in this way to assign the position of the ejector in relation to the opening roller to the respective position on the circumference. In this case, the guide device has been advantageously designed in such a manner that the ejectors are forced to project between the opening elements because of the curved guide, wherein the respective circulating ejector projects the deepest between the opening elements when passing the comb-out location, and is lifted off the farthest from the base body of the opening roller at the point where the fibers separate from the opening roller. Thus, the fibers are always located above the ejector, and the stripping-off process can be performed without difficulty.

If the number of revolutions of the opening roller is so high that centrifugal force alone lifts the ejectors, a device providing an appropriate radial force, which is oriented outwardly from the opening roller, can be omitted. If the number of revolutions of the opening roller has been reduced too greatly to dependably lift the ejectors off the opening roller, the opening roller can have springs that provide an outward-directed force and, together with the centrifugal force, dependably cause the lifting of the ejectors.

The centrifugal force, as well as the spring force, press the ejectors against the ring-shaped guide device and assure that the ejectors rest against the inner surface of the guide device and follow the predetermined inner contours. Thus, it is an advantage that neither special drive mechanisms nor separate expensive control devices for moving the ejectors need to be provided.

In accordance with the present invention, the opening arrangement takes up little space and requires only a small outlay of additional components in comparison with a normal customary opening roller yet can be cost-effectively produced.

Aside from its employment with spinning processes wherein, because of the requirement for continuously stretched fibers, the number of revolutions of the opening roller is limited, the opening arrangement in accordance with the present invention is also suitable for employment with open-end rotor spinning frames for opening fibers there, that have a strong tendency to winding, for preventing circulating fibers, or the formation of laps, and to make possible gentler, lower numbers of revolutions of the opening rollers possible in connection with man-made fibers.

Further details of the present invention can be gathered from a non-limiting exemplary embodiment presented in the following description with reference made to the drawings.

DESCRIPTION OF THE PREFERRED EMBODIMENT

Figure 1:
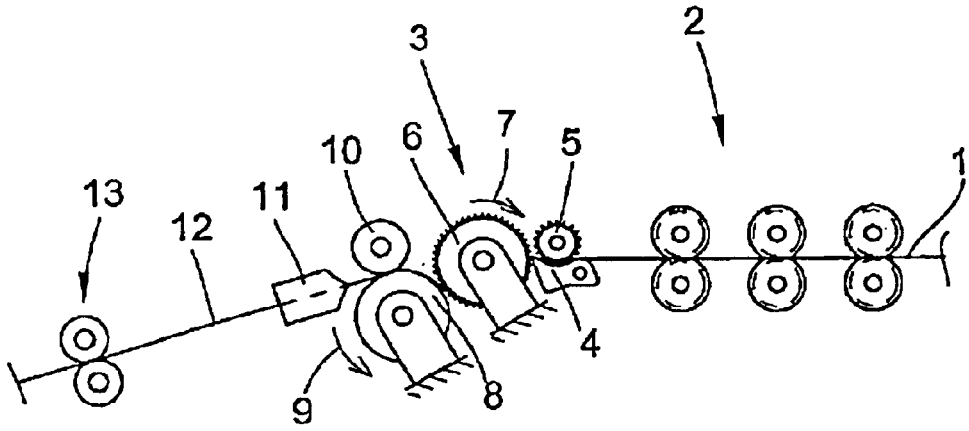
PRIOR ART FIG. 1
FIG. 1 is a schematic representation of an open-end spinning position.

In the spinning position of FIG. 1, a sliver 1 is conducted through a sliver-spreading device 2 and is fed in the spread state to the opening arrangement 3. The feed trough 4 presses the spread sliver 1 against the draw-in roller 5 and, together with the draw-in roller 5, forms a nip, which holds back the end of the sliver 1, the so-called fiber tuft. The opening roller 6 combs the fiber tuft out and separates the sliver 1 into individual fibers. In the course of this, the opening roller 6 rotates in the direction of the arrow 7. The fibers are taken over by a receiving roller 8, to which suction is applied, and are brought together to form a small narrow fiber tape. The direction of rotation of the receiving roller 8 is indicated by the arrow 9. The receiving roller 8 and the clamping roller 10 form a nip line, through which the small fiber tape runs. The air-spinning device 11 creates an air vortex, which is used to form a yarn. Such air-spinning devices are known, for example from German Patent Publication DE 196 10 960 A1. The yarn 12 passes through a withdrawal arrangement 13 and is conveyed to a winding station (not shown).

Figure 2:
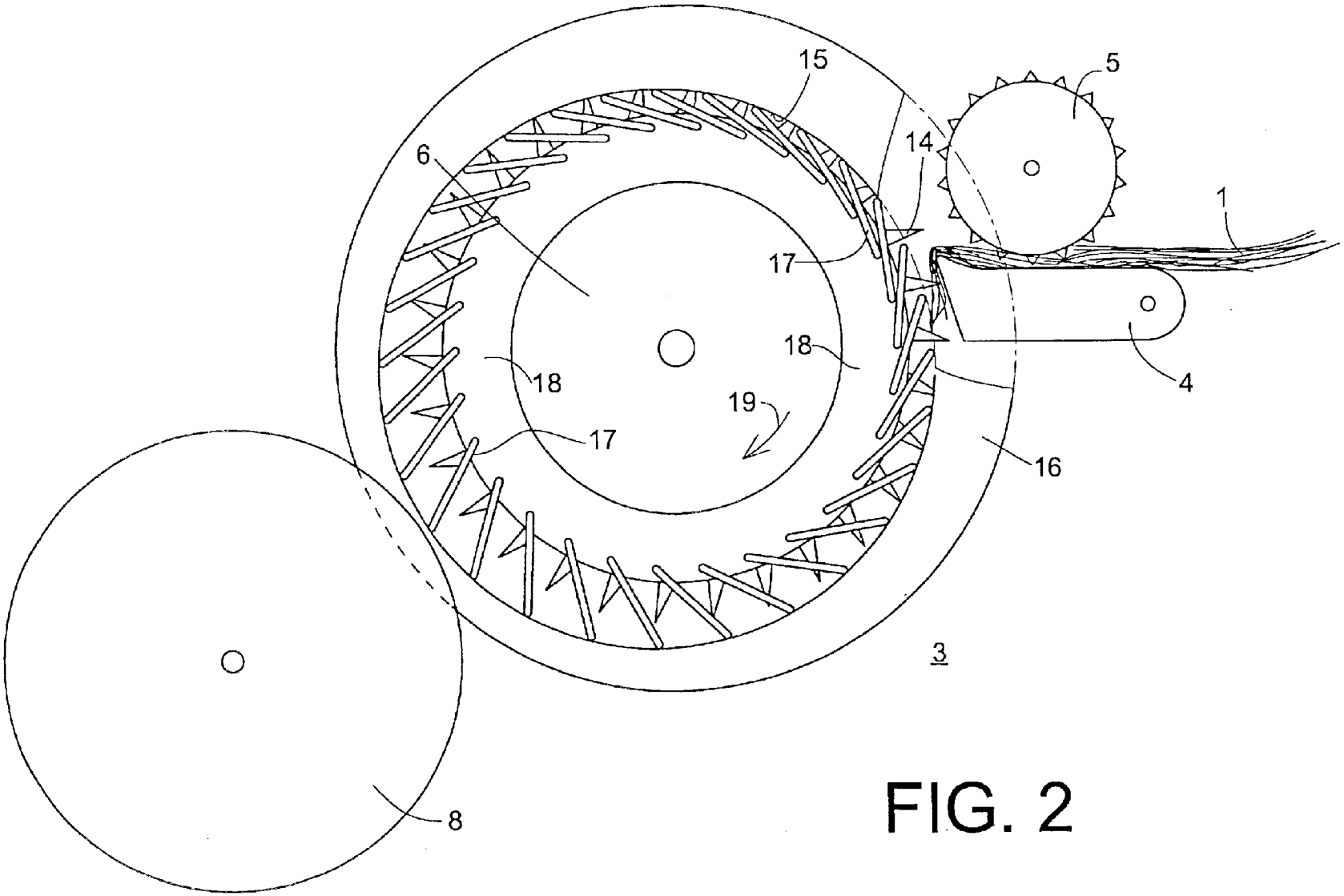
FIG. 2 is a partial view of an opening arrangement.
Figure 2A:
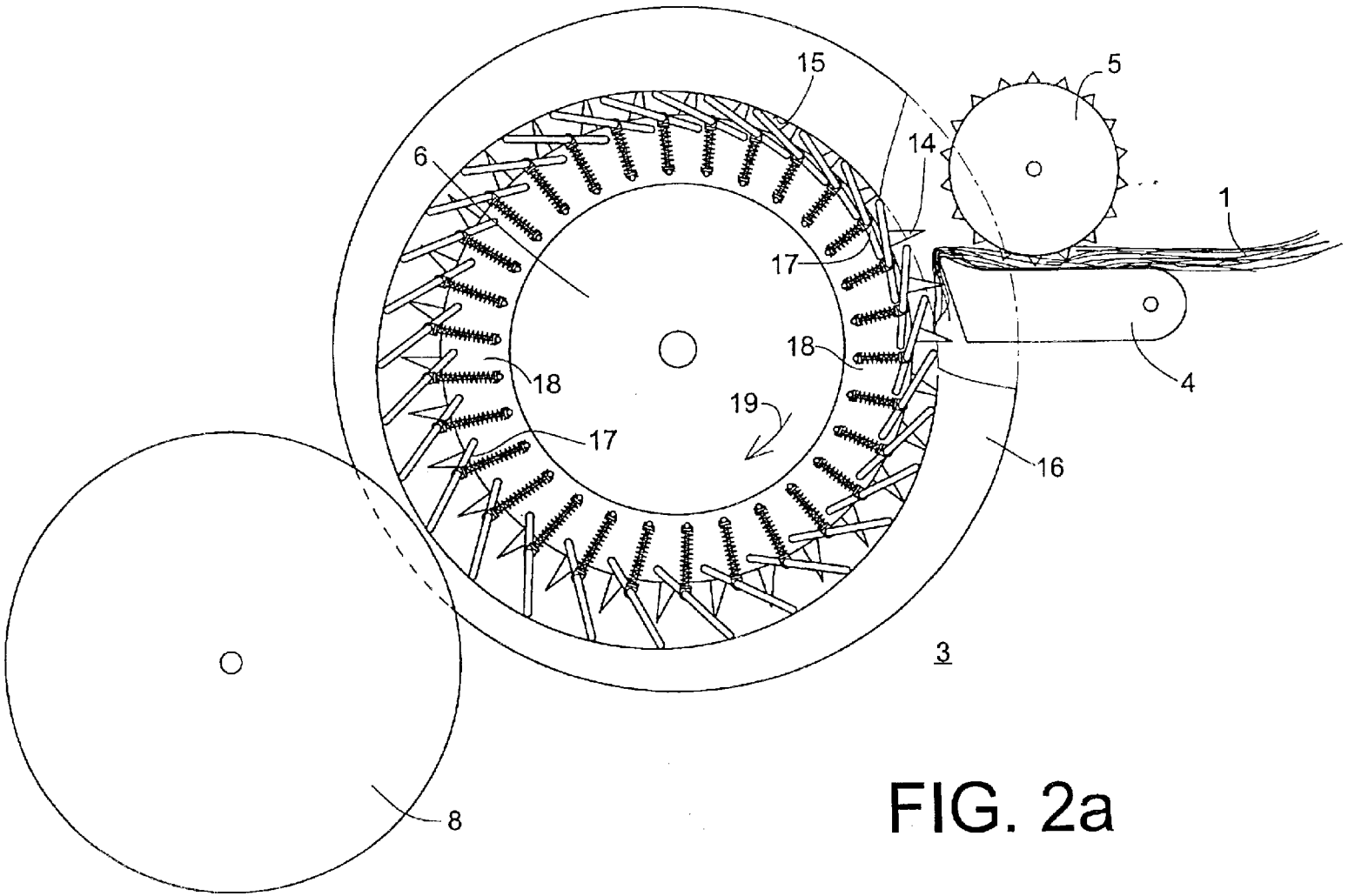
FIG. 2*a* is another partial view of an opening arrangement.

In the partial view of the opening arrangement 3 of FIG. 2 and FIG. 2*a*, sliver 1 is clamped between the feeding trough 4 and the draw-in roller 5 and fed to the opening roller 6. With opening elements embodied as needles 14, the opening roller 6 reaches into the fiber tuft of the sliver 1 and combs out fibers.

Figure 3:
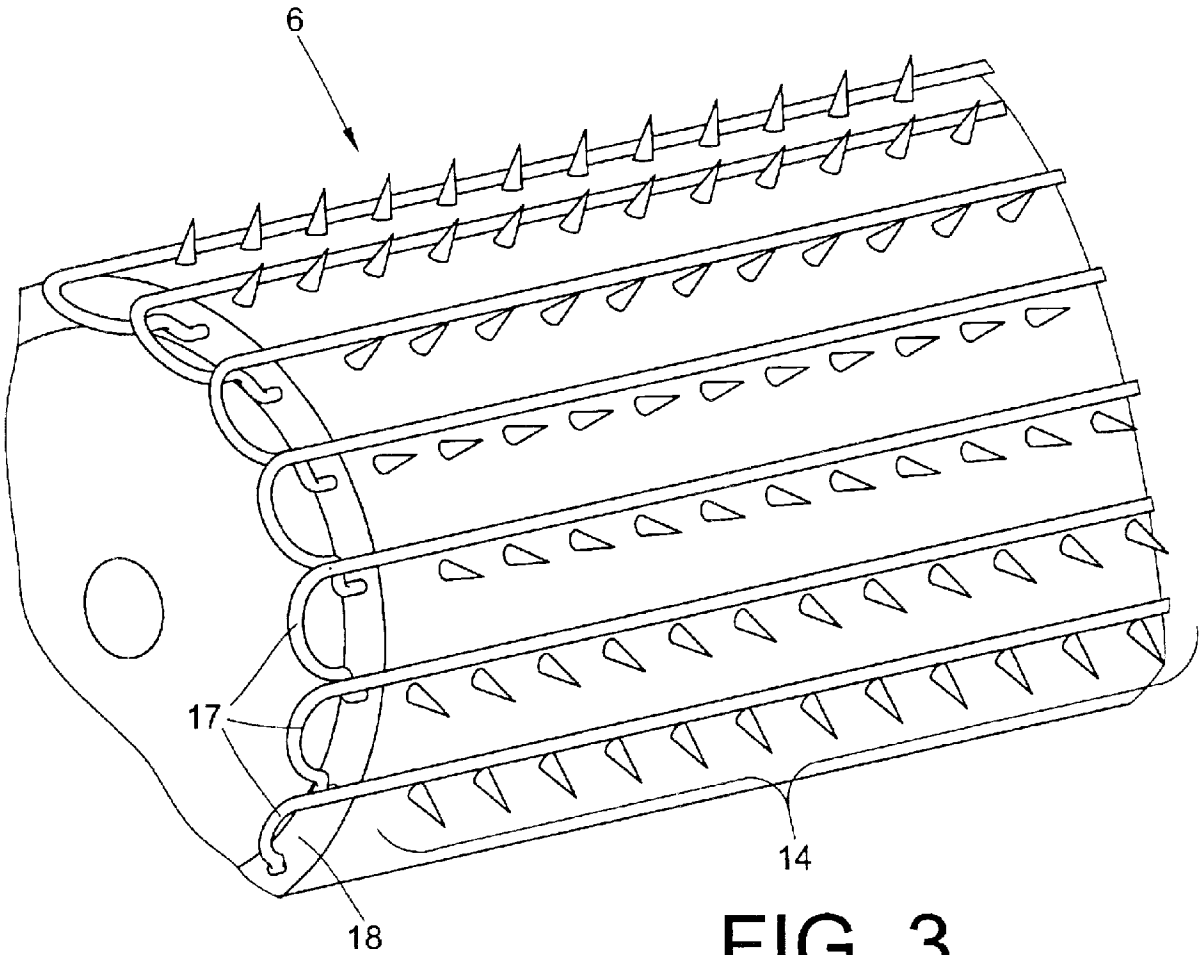
FIG. 3 is a perspective partial view of the opening roller in FIG. 2.

The inner contour 15 of the stationary ring-shaped guide device 16 extends eccentrically in relation to the opening roller 6 in such a way, that the distance between the inner contour 15 and the opening roller 6 is the least at the comb-out point, and in the area of the transfer zone to the receiving roller 8 is the greatest. The ejectors 17, embodied as symmetrical wire hoops, rest with a portion against the inner contour 15. The ejectors 17 are pivotably fastened on lateral rims 18 of the opening roller 6 and thus circulate, together with the opening roller 6, in the direction of the arrow 19. Each ejector 17 is held in bores facing each other, cut into both sides of the rims 18. During the rotation of the opening roller, the ejectors 17 are continuously acted upon by centrifugal force and are pressed against the inner contour 15 of the guide device 16. The guide device 16 is embodied as a plastic ring, so that the ejectors 17 can glide on the inner contour 15 without problems. Since the distance between the inner contour 15 and the opening roller 6 is short at the comb-out point, the injectors 17 are guided by the inner contour 15 in such a way that, when passing the comb-out point, they project the farthest between the needles 14. FIG. 3 also shows this position of the ejectors. In this case, the tips of the needles 14 project past the ejectors 17.

Viewed in the direction of rotation of the opening roller 6, the gap between the inner contour 15 and the opening roller 6 initially becomes steadily wider after the comb-out point. The ejectors 17, on which centrifugal force acts, steadily lift off the opening roller 6 on their circulating course until, when passing the point where the fibers are separated from the opening roller 6, they are lifted the farthest off the base body of the opening roller 6. In this case, the portion of the ejectors 17 that extends transversely over the opening roller 6, is at a greater distance from the base body of the opening roller 6 than the tips of the needles 14, which can be seen in FIG. 4 and FIG. 5.

Thus, it is made possible to lift up the fibers, which were combed out by the needles 14 at the combing point and taken along, and to strip them off the needles.

Figure 4:
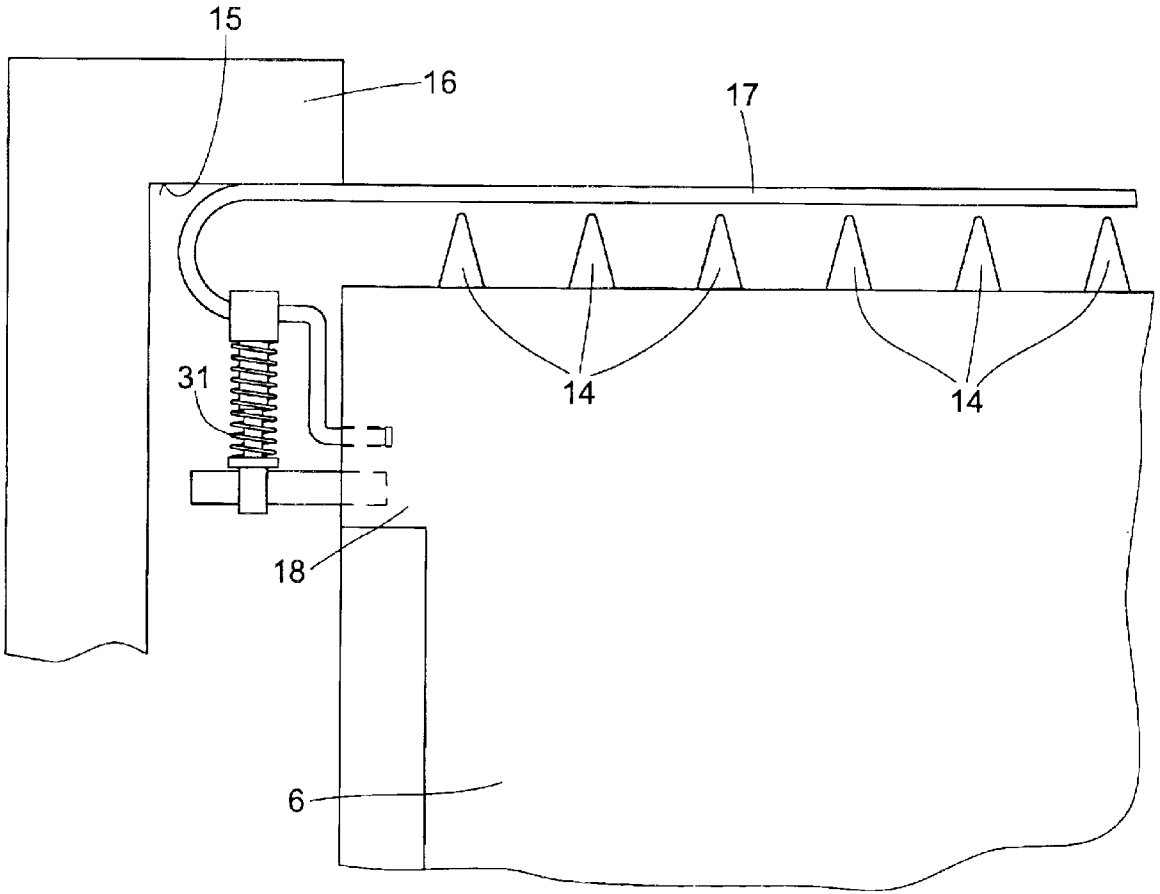
FIG. 4 is a sectional view of the guide device for the ejectors.
Figure 5:
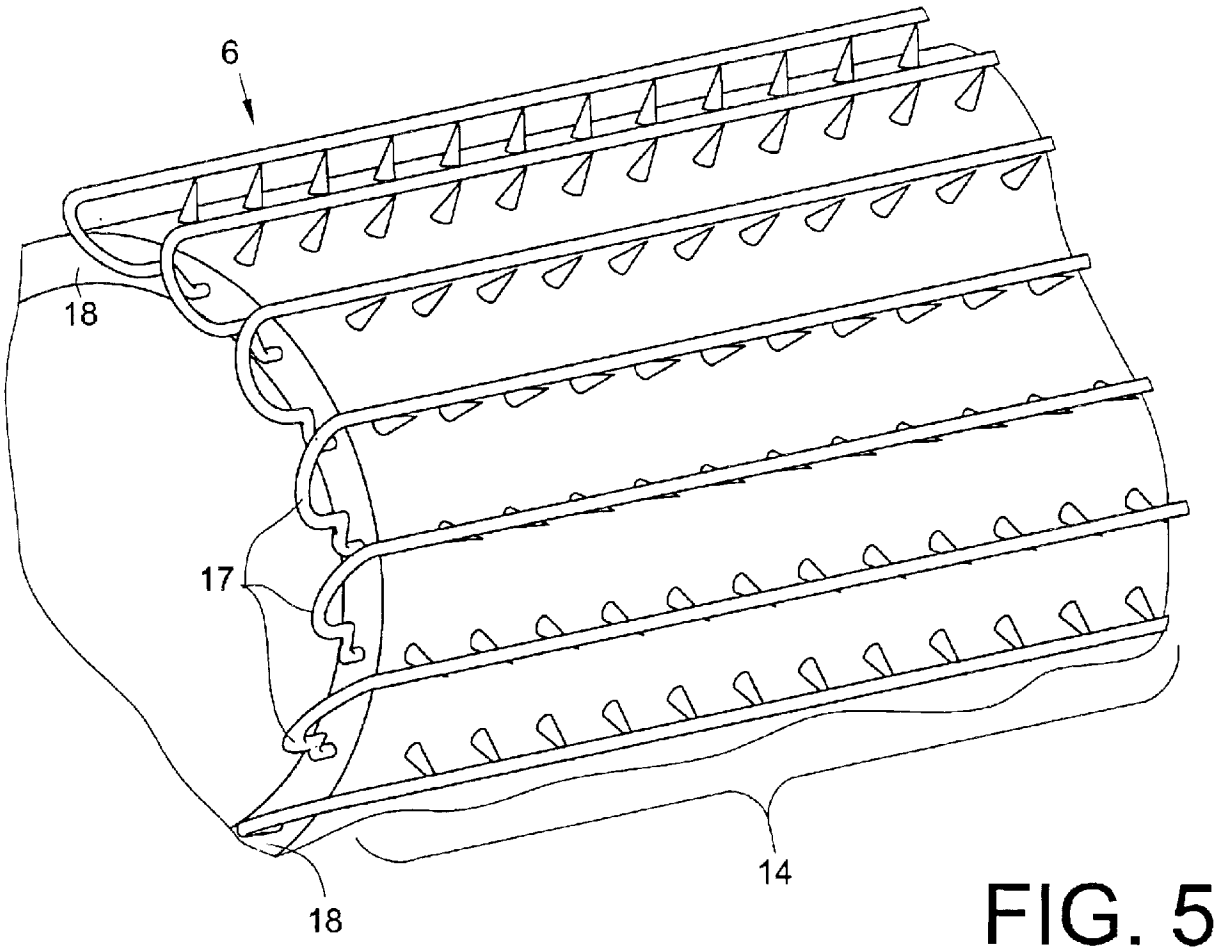
FIG. 5 is another perspective partial view of the opening roller in FIG. 2.

FIG. 4 shows an embodiment of the opening arrangement, wherein a spring 31 acts on each of the ejectors 17. The spring is embodied as a pressure spring and acts with a substantially outward directed force on the ejector 17. The effect of centrifugal force with which the ejector 17 is pressed against the inner contour of the guide 16 is aided by the spring 31. In a further embodiment, not represented, a spring 31 can act on each end of the ejector 17.

Figure 6:
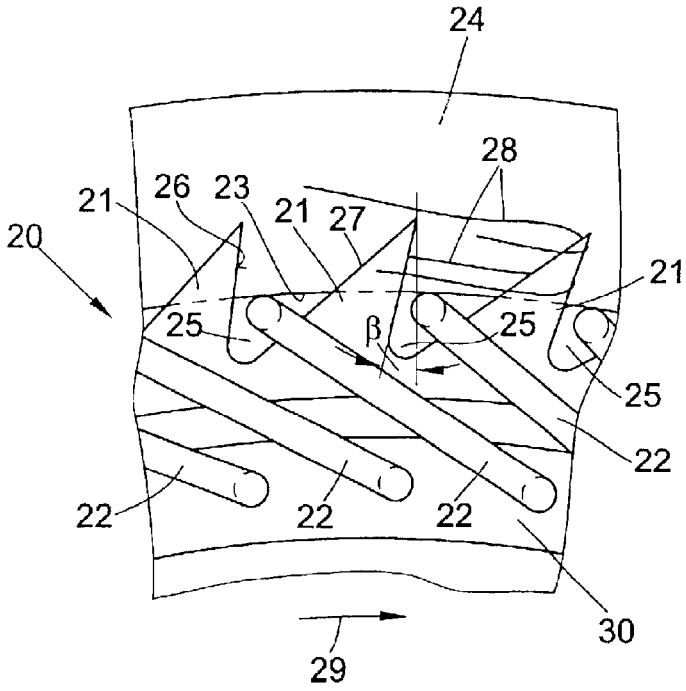
FIG. 6 is a partial view of a saw-tooth-equipped opening roller with ejectors.
Figure 7:
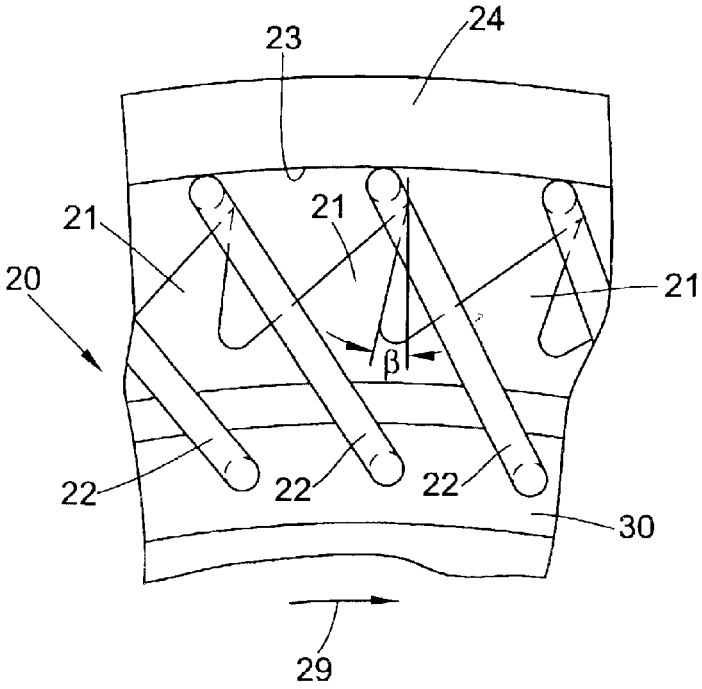
FIG. 7 is another partial view of a saw-tooth-equipped opening roller with ejectors.

FIG. 6 and FIG. 7 each show a portion of an opening roller 20, whose opening elements are designed as teeth 21. An opening roller with a suitable set of teeth is known from German Patent Publication DE 34 39 664 C2, for example. The structure of the opening arrangement is analogous to the opening arrangement 3 in FIGS. 1 and 2, wherein the variation substantially consists in the opening roller 20 having teeth 21, instead of needles.

FIG. 6 shows the position of the ejectors 22 in relation to the opening roller 20 when passing the combing point. The ejectors 22 rest with the transverse bow against the inner contour 23, shown partially in dashed lines, of the guide device 24, and project deeply into the cuts 25 between the rows of teeth formed in the axial direction. The cuts 25 are bordered by the front faces 26 and the rear faces 27 of the teeth 21.

The teeth have a positive face angle β. A positive face angle β, in particular a large face angle β, contributes considerably to the satisfactory opening of the fiber material. The teeth 21 comb fibers 28 out of the delivered fiber material, for example a sliver, as represented in FIG. 2. In the process, the fibers 28 are placed around the front face 26 of the teeth 21 and are carried along. The ejectors are placed under the fibers 28. The number and position of the fibers 28 is merely represented by way of example. On the conveyed path of the fibers 28 in the direction of rotation of the opening roller 20 (the direction of rotation is indicated by the arrow 29) from the comb-out point to the point where the fibers 28 are transferred to the receiving roller, the inner contour 23 steadily moves away from the base body of the opening roller 20. As a result, the ejectors 22 can pivot outward under the effect of centrifugal force in their seating in the rim 30 of the opening roller 20 and can lift off the base body of the opening roller 20. At the point where the fibers are separated from the opening roller, the ejectors 22 have been lifted the farthest. FIG. 7 shows this position of the ejectors 22 in relation to the opening roller 20. The portion of the ejectors 22 extending transversely of the opening roller 20 is therefore further removed from the base body of the opening roller 20 than the tips of the teeth 21. The fibers 28 are grasped by the ejectors 22 and lifted in the course of the lift-off of the ejectors 22. At the latest, when they reach the tip of the respective tooth 21, the fibers 28 are removed from the opening roller 20 and are transferred to the receiving roller.

A release of the fibers 28 from the respective tooth 21 can already be triggered at the start of the relative movement between the fiber 28 and the tooth 21 in the direction of the tooth tip.

The stripping device in accordance with the present invention can be integrated in an opening arrangement without difficulty. The production and mounting of the components of the opening arrangement can be performed simply and cost-effectively. No additional drive elements are required.

The present invention is not limited to the preferred embodiments and examples of use. For example, in place of a receiving roller to which suction is applied, it is possible to employ a perforated belt to which suction is applied, that moves in the axial direction of the opening roller and upon which the fibers released from the opening roller are collected and moved away.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An opening arrangement for an open-end spinning device comprising:

a rotating opening roller having opening elements stationarily arranged on its circumference for opening a delivered sliver into individual fibers and for combing the fibers at a comb-out point, the rotating opening roller having a mechanical stripping arrangement that rotates along with the rotating opening roller in a direction of rotation.

2. The opening arrangement in accordance with claim 1, wherein the mechanical stripping arrangement comprises an ejector that moves in relation to the opening roller and that is arranged between the opening elements.

3. The opening arrangement in accordance with claim 2, wherein the ejector extends over the opening roller transversely in relation to the direction of rotation.

4. The opening arrangement in accordance with claim 2, wherein the ejector is associated with a row of the opening elements that substantially extends transversely in relation to the direction of rotation of the opening roller.

5. The opening arrangement in accordance with claim 2, wherein the ejector is pivotably fastened on the opening roller.

6. The opening arrangement in accordance with claim 2, wherein the ejector is a wire hoop.

7. The opening arrangement in accordance with claim 2, wherein the ejector has a guide device arranged such that by its action the ejector cyclically changes position in relation to the opening roller.

8. The opening arrangement in accordance with claim 7, wherein the guide device is stationary.

9. The opening arrangement in accordance with claim 7, wherein the guide device is ring-shaped.

10. The opening arrangement in accordance with claim 7, wherein the guide device is arranged such that a curved guide forcibly causes the ejector to project between the opening elements.

11. The opening arrangement in accordance with claim 10, wherein the ejector projects deepest between the opening elements when passing the comb-out point.

12. The opening arrangement in accordance with claim 2, wherein the ejector is lifted off farthest from the opening roller at a point where the fibers separate from the opening roller.

13. The opening arrangement in accordance with claim 2, wherein the ejector is lifted off the opening roller by centrifugal force.

14. The opening arrangement in accordance with claim 2, wherein the mechanical stripping device has a spring acting on the ejector to aid in lifting the ejector by centrifugal force in a substantially outward direction.

* * * * *